US005729818A

United States Patent [19]

Ishizuka et al.

[11] Patent Number: 5,729,818

[45] Date of Patent: Mar. 17, 1998

[54] IMAGE FORMING APPARATUS HAVING A FIXING DEVICE AND A CONVEYER MEANS FOR CONVEYING A RECORDING MEMBER TO THE FIXING DEVICE

[75] Inventors: Jiro Ishizuka, Chiba; Rie Saito, Yokohama, both of Japan

[73] Assignee: Canon Kabushiki Kaisha, Tokyo, Japan

[21] Appl. No.: 674,736

[22] Filed: Jul. 2, 1996

[30] Foreign Application Priority Data

Jul. 7, 1995 [JP] Japan ..... 7-172069
May 20, 1996 [JP] Japan ..... 8-124626

[51] Int. Cl.[6] ..... G03G 15/00; G03G 15/20

[52] U.S. Cl. ..... 399/400; 399/68

[58] Field of Search ..... 399/325, 400, 399/330, 331, 68; 219/216, 469–471

[56] References Cited

U.S. PATENT DOCUMENTS 4,549,803 10/1985 Ohno et al. ..... 399/325 X
5,049,934 9/1991 Saito .
5,075,732 12/1991 Menjo ..... 399/325 X
5,463,457 10/1995 Takeuchi et al. .
5,600,424 2/1997 Malachowski ..... 399/68

*Primary Examiner*—S. Lee
*Attorney, Agent, or Firm*—Fitzpatrick, Cella, Harper & Scinto

[57] ABSTRACT

An image forming apparatus for forming an image on a recording member includes an unfixed image forming device for forming an unfixed image on the recording member, a fixing section which has a nip, and which holds and conveys the recording member carrying the unfixed image through the nip to fix the unfixed image on the recording member, and a conveyor for conveying the recording member to the fixing section. The conveyor can convey the recording member at a first speed, or at a second speed which is slower than the first speed. The conveyor conveys the recording member at the first speed before a leading end of the recording member is held by the nip, and at the second speed after the leading end is held by the nip. With such a construction, the recording member can be forcibly inserted into the nip, and can be prevented from slipping at the entrance of the nip.

32 Claims, 13 Drawing Sheets

IMAGE FORMING APPARATUS HAVING A FIXING DEVICE AND A CONVEYER MEANS FOR CONVEYING A RECORDING MEMBER TO THE FIXING DEVICE

BACKGROUND OF THE INVENTION

1. Field of the Invention

The present invention relates to an image forming apparatus having a fixing device for fixing an unfixed image carried by a recording member, and a means for conveying the recording member carrying the unfixed image to the fixing device.

2. Description of the Related Art

A conventional image forming apparatus will be described.

In a fixing device of a conventional image forming apparatus, it is common for a fixing roller and a pressure roller to be pressed into contact with each other to form a nip therebetween, and for a recording member carrying an unfixed toner image to be clamped and conveyed by the nip to perform fixing.

In an apparatus of this type, when an image forming operation is performed on a recording member having at least a resin layer on the surface thereof, such as a transparent laminated film for OHP and a coated paper, it is preferable to smooth the surface of the fixed image for obtaining an excellent image quality. To this end, fixing is performed by improving fixing properties, and by applying a larger amount of heat to the toner so as to sufficiently fuse the toner.

In addition, when the recording member is cardboard, a large amount of heat is absorbed by the cardboard. Thus, the fixing is performed by improving fixing properties and by applying a larger amount of heat to the recording member.

In order to improve fixing properties, fixing temperatures may be increased. However, it takes a long period of time to increase the temperatures. Thus, from the viewpoint of responsiveness, it is not preferable to improve fixing properties by increasing fixing temperatures.

It is preferable from the viewpoint of responsiveness to improve fixing properties by reducing a speed of a fixing device conveying the recording member for prolonging the fixing time.

Conventionally, when the recording member is the transparent laminated film, a speed of a conveyor belt for conveying the transparent laminated film to the fixing device is slowed down before the transparent laminated film reaches the fixing device.

That is to say, the recording member moves into a nip formed between the roller pair at the same reduced speed as the reduced rotative speed of the roller pair.

However, when the recording member is conveyed to the nip at the same speed as the roller pair, which is rotating at a low speed, the recording member becomes difficult to move into the nip, and the time required for the entire image forming may be prolonged.

In addition, since a releasing oil applied to or impregnated in the surface of the rollers is accumulated in the vicinity of the nip formed between the rollers, the recording member may slip and jam at the entrance of the nip and stains may be produced on the recording member.

SUMMARY OF THE INVENTION

It is an object of the present invention to provide an image forming apparatus in which no slippage of a recording member is caused before the recording member is clamped by a nip of fixing means.

It is another object to provide an image forming apparatus taking a short period of time for forming an image by increasing the speed of the recording member to be conveyed to the nip of the fixing means.

According to one aspect of the present invention, an image forming apparatus comprises an unfixed image forming means for forming an unfixed image on a recording member; fixing means having a nip, the fixing means holding and conveying the recording member carrying the unfixed image with the nip and fixing the unfixed image onto the recording member; and conveyor means for conveying the recording member to the fixing means, wherein the conveyor means can convey the recording member at one of a first speed and a second speed slower than the first speed, and wherein the conveyor means conveys the recording member at the first speed before the leading end of the recording member enters the nip, and at the second speed after the leading end enters the nip.

According to another aspect the present invention, an image forming apparatus comprises an unfixed image forming means for forming an unfixed image on a recording member conveyed with a first speed; fixing means for fixing the unfixed image on the recording member; and conveyor means for conveying the recording member to the fixing means, wherein the conveyor means selectively conveys the recording member at one of the first speed and a second speed which is faster than the first speed.

According to yet another aspect of the present invention, a fixing device comprises a rotation member having a release agent on the surface thereof; and a press-contact member pressed into contact with the rotation member and forming a nip therebetween, wherein the rotation member can rotate at one of a first speed and a second speed slower than the first speed, and wherein the rotation member rotates at the first speed before a leading end of the recording member is held by the nip, and at the second speed after the leading end of the recording member is held by the nip.

Further objects, features, and advantages of the present invention will become apparent from the following description of the preferred embodiments with reference to the attached drawings.

DETAILED DESCRIPTION OF THE PREFERRED EMBODIMENTS

A first embodiment of the present invention will now be described with reference to the accompanying drawings.

Figure 6:
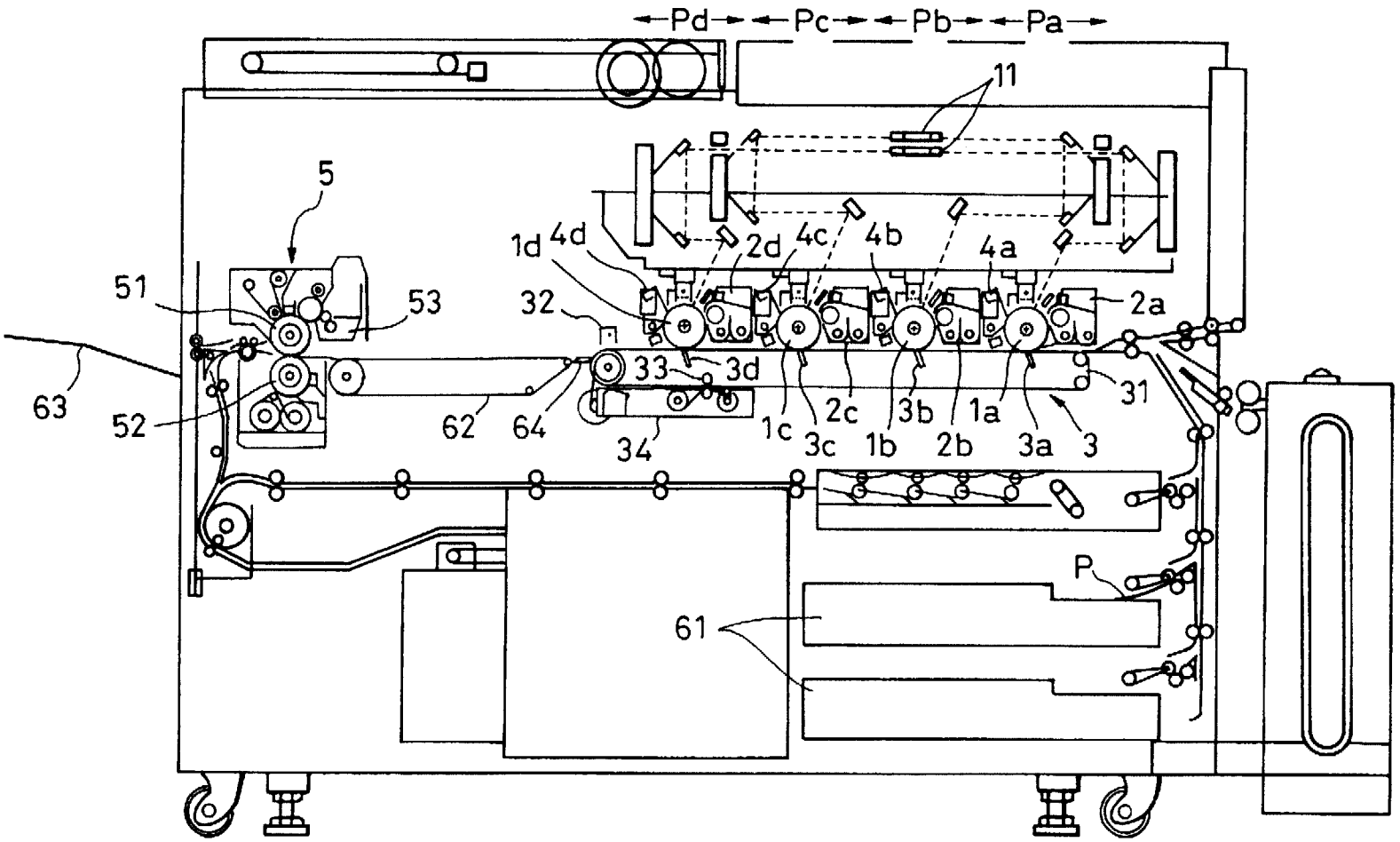
FIG. 6 is a schematic sectional view of an image forming apparatus to which the present invention is applied.
Figure 7:
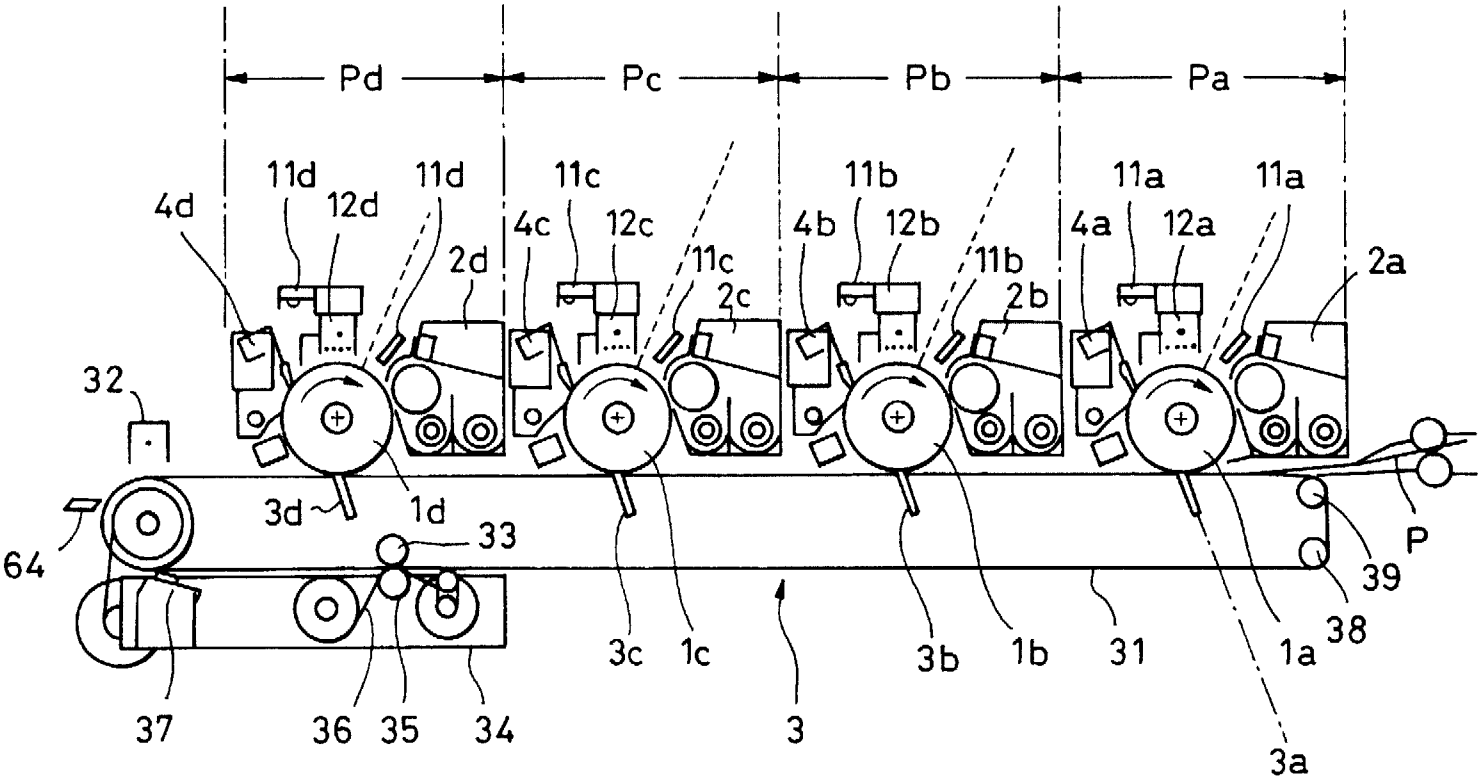
FIG. 7 is an enlarged view which illustrates an image forming section of FIG. 6.
Figure 8:
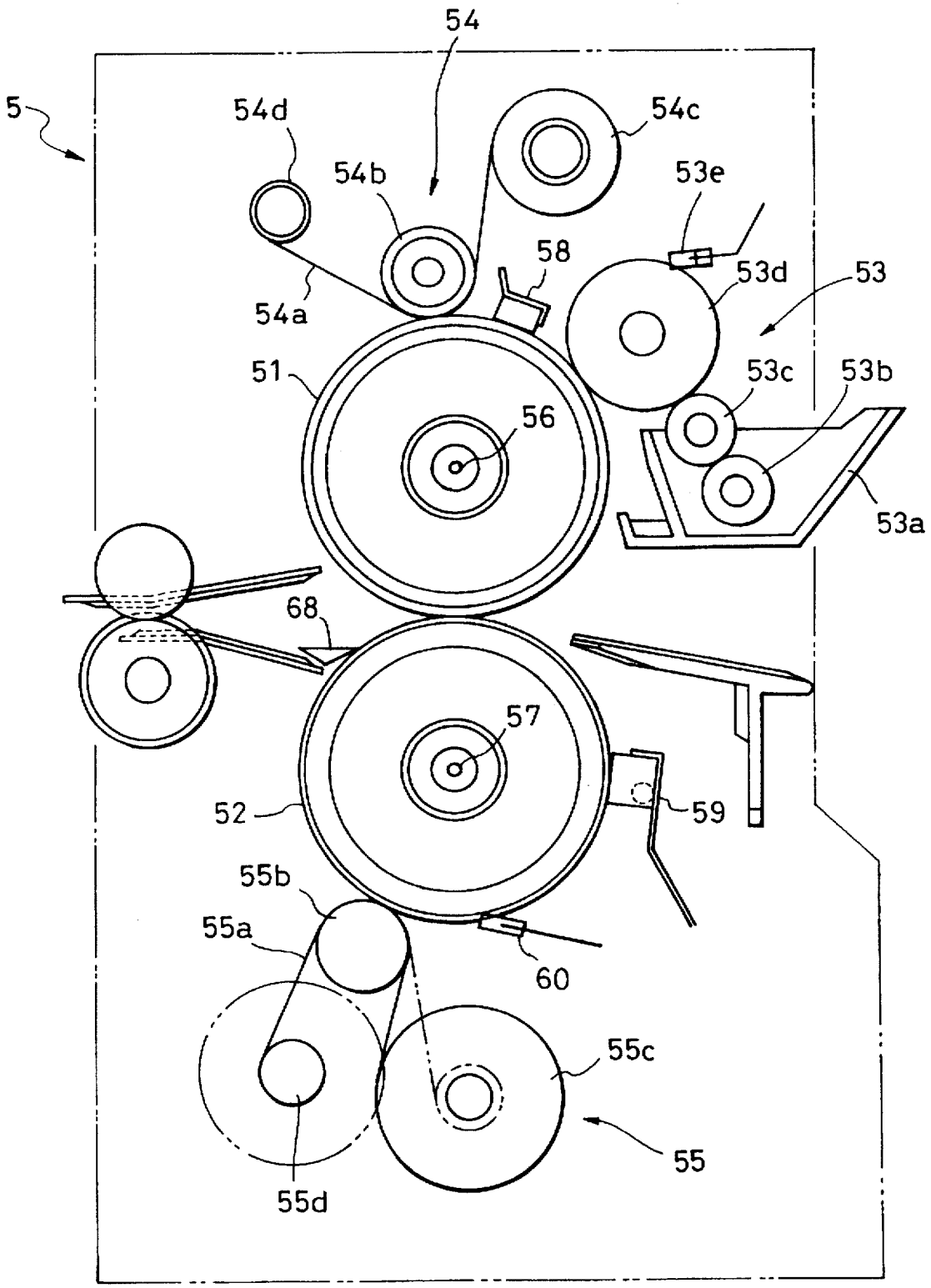
FIG. 8 is an enlarged view which illustrates a fixing device of FIG. 6.

FIG. 6 is a schematic sectional view of a full-color copier which is an image forming apparatus to which the present invention is applied; FIG. 7 is an enlarged view of an image forming section of FIG. 6; and FIG. 8 is an enlarged view of a fixing device of FIG. 6.

The full-color copier will be briefly described with reference to FIGS. 6 to 8.

As shown in FIG. 6, four image forming stations for forming an image and each having a developing device and the like are provided around an electrophotographic photosensitive member (hereinafter, referred to as "a photoconductive drum") which is a latent image carrier, so that images on the photoconductive drum formed by the image forming stations Pa, Pb, Pc and Pd are transferred to a recording member P (also, referred to as a transfer paper P) such as a plain paper sheet on a conveyer means which moves adjacent to the photoconductive drum.

Above the image forming stations, a reader section is provided for reading originals by a photoelectric conversion element such as a CCD.

As shown in FIG. 7, in the image forming stations Pa, Pb, Pc and Pd for forming the magenta, cyan, yellow and black images, respectively, photoconductive drums 1*a*, 1*b*, 1*c* and 1*d* are disposed. Each of the photoconductive drums 1(*a*)–1(*d*) are rotatable in the directions of the arrows. Charging units 12*a*, 12*b*, 12*c* and 12*d*, laser scanning sections, developing units 2*a*, 2*b*, 2*c* and 2*d*, and cleaners 4*a*, 4*b*, 4*c* and 4*d* are sequentially provided along the direction of the rotation of the photoconductive drums 1*a*, 1*b*, 1*c* and 1*d*. A transfer section 3 is provided under the photoconductive drums 1(*a*)–1(*d*). The transfer section 3 includes a transfer belt 31 which is a recording member conveyer means common to each of the image forming stations P(a)–P(d) and transfer charging units 3*a*, 3*b*, 3*c* and 3*d*.

In such a copier as described above, transfer paper P fed from a paper feeding cassette 61, which is the recording member feeding means shown in FIG. 6, is supported on the transfer belt 31 and conveyed to the image forming sections P(a)–P(d), so that toner images of each color formed on the photoconductive drums 1*a*, 1*b*, 1*c* and 1*d* are sequentially transferred thereon. When the transfer step is finished, the transfer paper P is separated from the transfer belt 31, and is conveyed to a fixing device 5 by a conveyor belt 62 which is a recording member guide means.

The fixing device 5, as shown in detail in FIG. 8, includes a fixing roller 51 which is a rotatably provided fixing rotation member, a pressure roller 52 which is a pressing rotation member rotating while press-contacting the fixing roller 51, a release agent application device 53 for supplying and applying a release agent, and roller cleaning devices 54 and 55. Heaters 56 and 57, such as halogen lamps, are provided inside of the fixing roller 51 and pressure roller 52, respectively. Thermistors 58 and 59 are provided so as to come into contact with the fixing roller 51 and the pressure roller 52, respectively. By controlling voltages to be applied to the heaters 56 and 57 through a temperature control circuit, temperatures on the surfaces of the fixing roller 51 and the pressure roller 52 are controlled.

In addition, the cleaning device 54 and the release agent application device 53 contact the fixing roller 51. A toner offset on the fixing roller 51 is cleaned by the cleaning device 54, and a release agent such as silicon oil is applied to the fixing roller 51 by release agent application device 53 so that the transfer paper P is easily separated from the fixing roller 51 and the toner is prevented from offsetting.

The cleaning device 54 consists of a cleaning web 54*a* formed of a belt-shaped heat-resistant unwoven cloth, a pressing roller 54*b* for pressing the cleaning web 54*a* to the fixing roller 51, a supply roller 54*c* for supplying a new length of cleaning web 54*a*, and a take-up roller 54*d* for gradually taking up the cleaning web 54*a* having cleaning capability lowered by toner and the like adhered thereon. Particularly, the cleaning device 54 is provided upstream of the direction of rotation of the fixing roller 51 with respect to the thermistor 58 in order that the offset toner will not adhere to the thermistor 58 to cause poor detection by the thermistor 58.

The release agent application device 53 includes an oil tank 53*a* containing a release agent such as silicon oil, rollers 53*b* and 53*c* for supplying the release agent from the oil tank 53*a*, an application roller 53*d* for applying the release agent or oil supplied from the rollers 53*b* and 53*c*, and a blade 53*e* for controlling the amount of application of the oil from the application roller 53*d*. More particularly, the release agent application device 53 is provided downstream of the direction of rotation of the fixing roller 51 with respect to the thermistor 58 in order to apply the oil uniformly to the fixing roller 51. The application roller 53*d* has a sponge rubber which the surface is coated with a silicon rubber, and abuts against the fixing roller 51 to apply the oil to the fixing roller 51.

The cleaning device 55 includes a cleaning web 55*a*, a pressing roller 55*b*, a supply roller 55*c* and take-up roller 55*d* similar to those of the cleaning device 54 of the fixing roller 51 and also contact the pressure roller 52 to perform cleaning of the toner adhered to the pressure roller 52 by the fixing roller 51.

In addition, an oil removing blade 60, which is a release agent removing elastic member for removing excess release agent remaining on the pressure roller 52, abuts against the pressure roller 52. When the oil removing blade 60 is not provided, the excess release agent accumulates in a nip formed between the fixing roller 51 and the pressure roller 52 (hereinafter, referred to as a fixing nip) to produce a stain on the recording member P, or a recording member P at least having a resin layer on the surface thereof such as a transparent laminated film for use in an OHP slips to impede entry of the recording member P to the fixing nip. As a material of the oil removing blade 60, silicon rubber or fluorine rubber may be used. The blade 60 abuts against the pressure roller 52 with a suitable amount of pressure to remove excess release agent and contacts the pressure roller 52 in the forward or reverse direction with respect to the direction of rotation of the pressure roller 52.

In this state, when the transfer paper P is conveyed into the fixing device 5, the fixing roller 51 and pressure roller 52 rotate and silicon oil is applied as the release agent to the surface of the fixing roller 51. The transfer paper P is pressurized and heated with a substantially constant pressure and temperature on both sides when passing through the fixing nip formed by, the fixing roller 51 and the pressure roller 52 collectively referred to as a fixing roller pair 51 and 52. An unfixed toner image on the surface of the transfer paper P is melted to be fixed so that a full-color image is formed on the transfer paper P. The transfer paper P on which the image is fixed is separated from the pressure roller 52 by means of a lower separator lug 68 and discharged out of the fixing device 5.

Since the length the conveyor belt 62 can convey the transfer paper P in this embodiment is longer than a maximum length in a direction of conveyance of the standard transfer paper P which the apparatus is set to form image onto, a trailing end of the transfer paper P will not be loaded on the transfer belt 31 when a leading end is clamped by the fixing nip formed by the fixing roller pair 51 and 52. In other words, transferring and fixing are not performed simultaneously on the same transfer paper P.

The transfer belt 31, conveyor belt 62 and fixing roller pair 51 and 52 are separately driven, and rotative speeds of the conveyor belt 62 and fixing roller pair 51 and 52 can be varied.

In the event that the recording member P is a plain paper (thickness: about 90 μm) (a first mode), the recording member is conveyed by the transfer belt 31, conveyer belt 62 and the fixing roller pair 51 and 52 at a constant speed (140 mm/sec).

A fixing operation when a transparent laminated film for OHP having at least a resin layer on the surface thereof is used as the recording member P will now be described with reference to FIG. 1.

Figure 1:
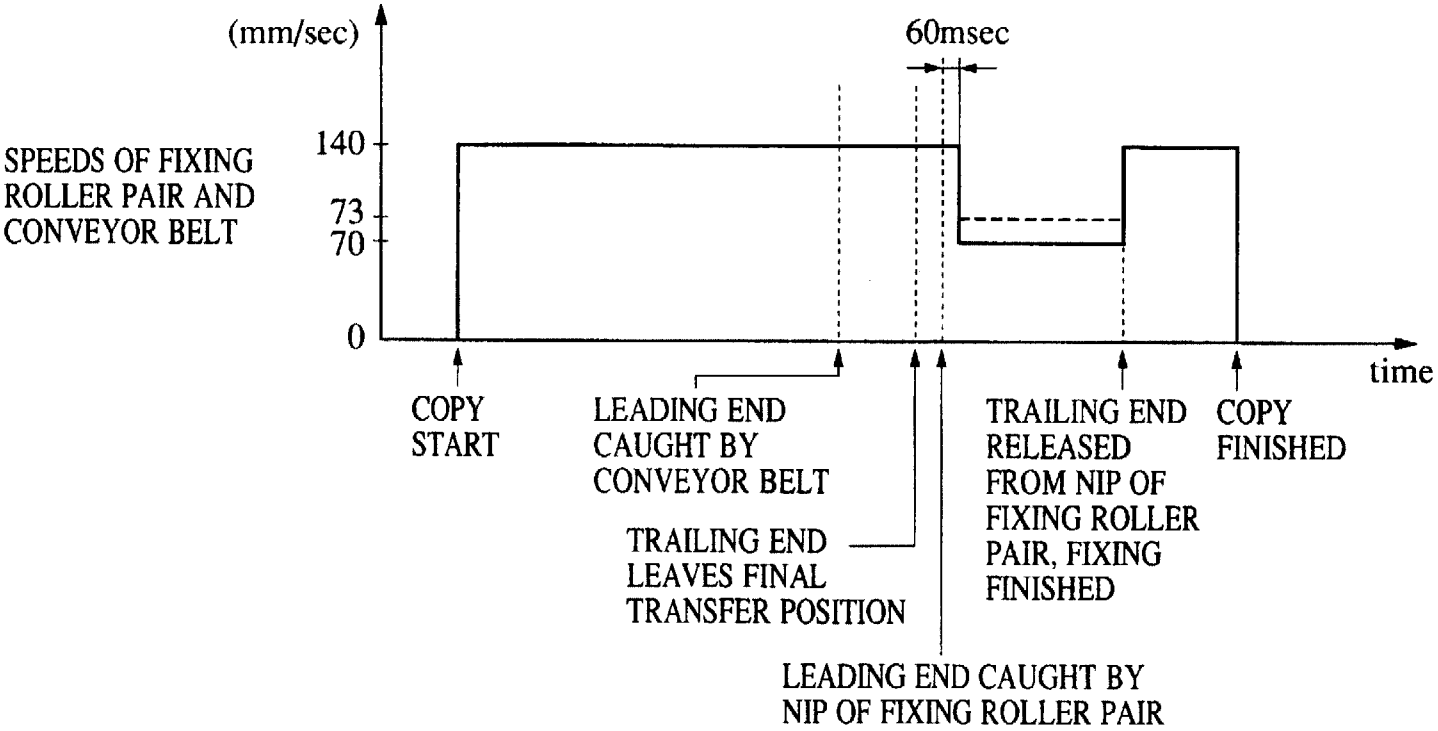
FIG. 1 is a schematic timing chart which illustrates a first embodiment of the present invention.

Referring to FIG. 1, the horizontal axis represents the time after starting a copying operation, and the vertical axis represents the rotative speeds of the fixing roller pair 51 and 52 and the conveyor belt 62. When a transparent laminated film mode (second mode) is set, and a copy button is pressed to start a copying operation, the fixing roller pair 51 and 52, and the conveyor belt 62 start to rotate at a speed of 140 mm/sec for conveying the transparent laminated film in accordance with the speed of the image forming section, e.g. transfer belt 31. Since the speed of the image forming section does not vary in accordance with the type of the recording member, the transfer belt 31 conveys the transparent laminated film at the same speed for conveying the plain paper.

Figure 2:
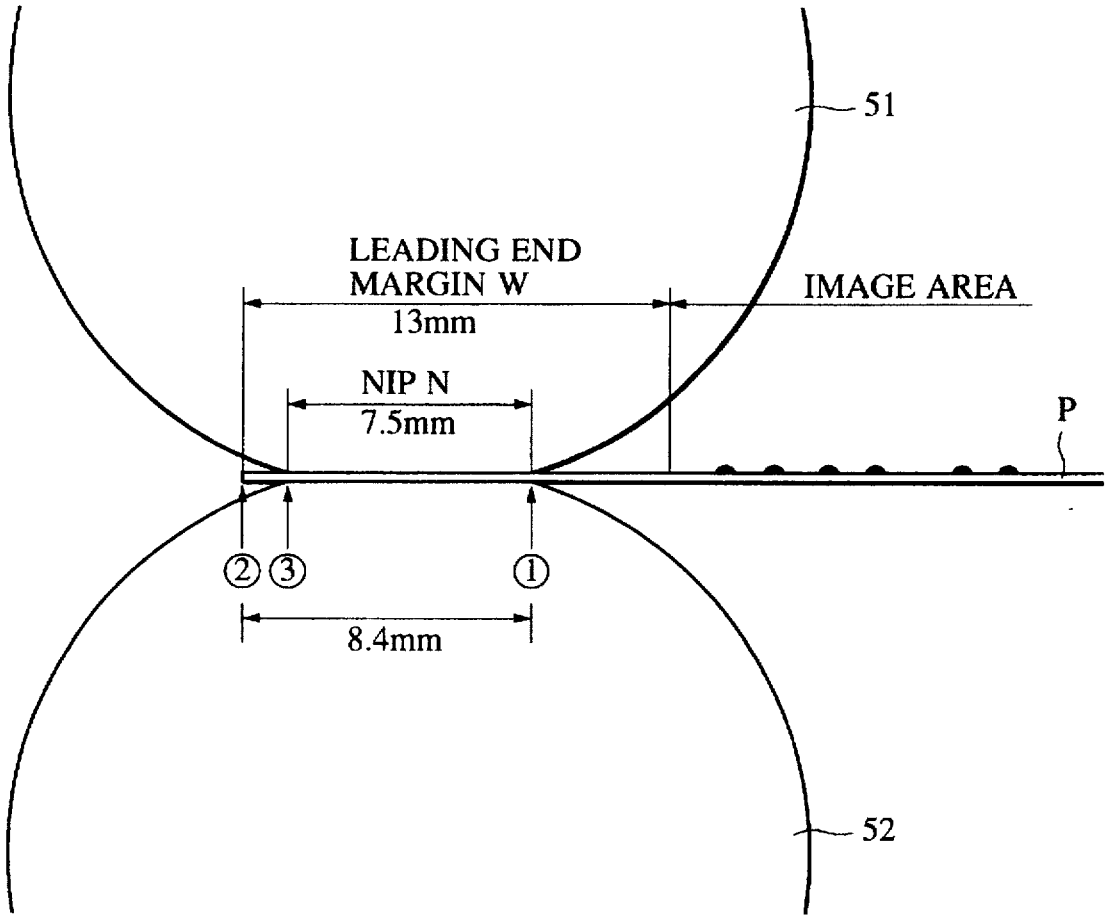
FIG. 2 is a view for explaining the first embodiment of the present invention.

After the trailing end of the transparent laminated film has passed through a final transfer position and a predetermined time of 60 msec expires since the leading end has moved into the entrance of the fixing nip, the speeds of the fixing roller pair 51 and 52 and the conveyor belt 62 are reduced from 140 mm/sec to 70 mm/sec, and increased to 140 mm/sec again after completion of fixing. That is, the conveyor belt 62 synchronizes its speed with the speed of fixing roller pair 51 and 52 to convey the transparent laminated film at the same speed. FIG. 2 illustrates the state of the fixing nip when the rotative speed of the fixing roller pair 51 and 52 is switched from 140 mm/sec to 70 mm/sec. As shown in FIG. 2, according to this embodiment, when the leading end of the transparent laminated film gets to the position (2), where 60 msec has passed since it reached the entrance (1) of the fixing nip, in other words, when the leading end of the transparent laminated film is clamped by the fixing roller pair 51 and 52 and the leading end exits the fixing nip at position (3), the rotative speed of the fixing roller pair 51 and 52 is switched from 140 mm/sec to 70 mm/sec. In this embodiment, since the width of the fixing nip N is 7.5 mm and the transparent laminated film advances 8.4 mm (=140 mm/sec×60 msec) from the entrance of the fixing nip, the rotative speed of the fixing roller pair 51 and 52 is switched when the leading end exits the fixing nip by 0.9 mm (=8.4 mm−7.5 mm).

In addition, according to this embodiment, the leading end of the transparent laminated film includes 13 mm of a leading end margin W on which no image is formed. When the leading end of the transparent laminated film is at the position of (2), the trailing end of the leading end margin W, e.g., the leading end of the image area, does not move into the fixing nip. That is, the distance the leading end of the transparent laminated film advances from the entrance of the fixing nip before the rotative speed of the fixing roller pair 51 and 52 is changed may be preferably shorter than the length of the leading end margin W of the transparent laminated film.

The reason for reducing the rotative speed of the fixing roller pair 51 and 52 with the above timing will now be described.

When an image is fixed on the transparent laminated film, the rotative speed of the fixing roller pair 51 and 52 is reduced to 70 mm/sec and the fixing time is prolonged to improve fixing properties. Thus, the surface of the image formed on the transparent laminated film can be smoothed to obtain a good image quality.

However, since the fixing roller pair 51 and 52 rotates slowly, oil or any other release agent applied to, and impregnated on the surfaces of the fixing roller pair 51 and 52 may usually accumulate at the entrance of the fixing nip.

According to this embodiment, at the moment when the transparent laminated film moves into the fixing nip, the rotative speed of the fixing roller pair 51 and 52 is not reduced but is maintained at a normal speed (140 mm/sec), the image forming speed (e.g., the speed of transfer belt 31). Therefore, the accumulation of oil at the entrance of the fixing nip can be prevented, whereby the transparent laminated film can be securely clamped.

In addition, according to this embodiment, the speed of the conveyor belt 62 for conveying the transparent laminated film to the fixing roller pair 51 and 52 remains at a high speed (140 mm/sec) when the transparent laminated film moves into the entrance of the fixing nip. Therefore, the transparent laminated film can be forcibly conveyed to the fixing nip, whereby slippage of the transparent laminated film caused at the time of rushing into the fixing nip can be prevented more surely.

Further, according to this embodiment, the leading end of the transparent laminated film is clamped and the fixing speed becomes slow before the image area moves into the fixing nip. Therefore, jamming or deterioration of image fixing properties is prevented.

In this embodiment, the speeds of the fixing roller pair 51 and 52 and the conveyor belt 62 are reduced after 60 msec since the leading end of the transparent laminated film has rushed into the fixing nip. However, the time of 60 msec is not limited thereto because it varies in accordance with the speed of the conveyor belt 62 of the apparatus. The speeds of the fixing roller pair 51 and 52 and the conveyor belt 62 may be reduced at least after an inrush of the transparent laminated film into the fixing nip.

A first comparative embodiment of this embodiment will now be described with reference to FIG. 3.

Figure 3:
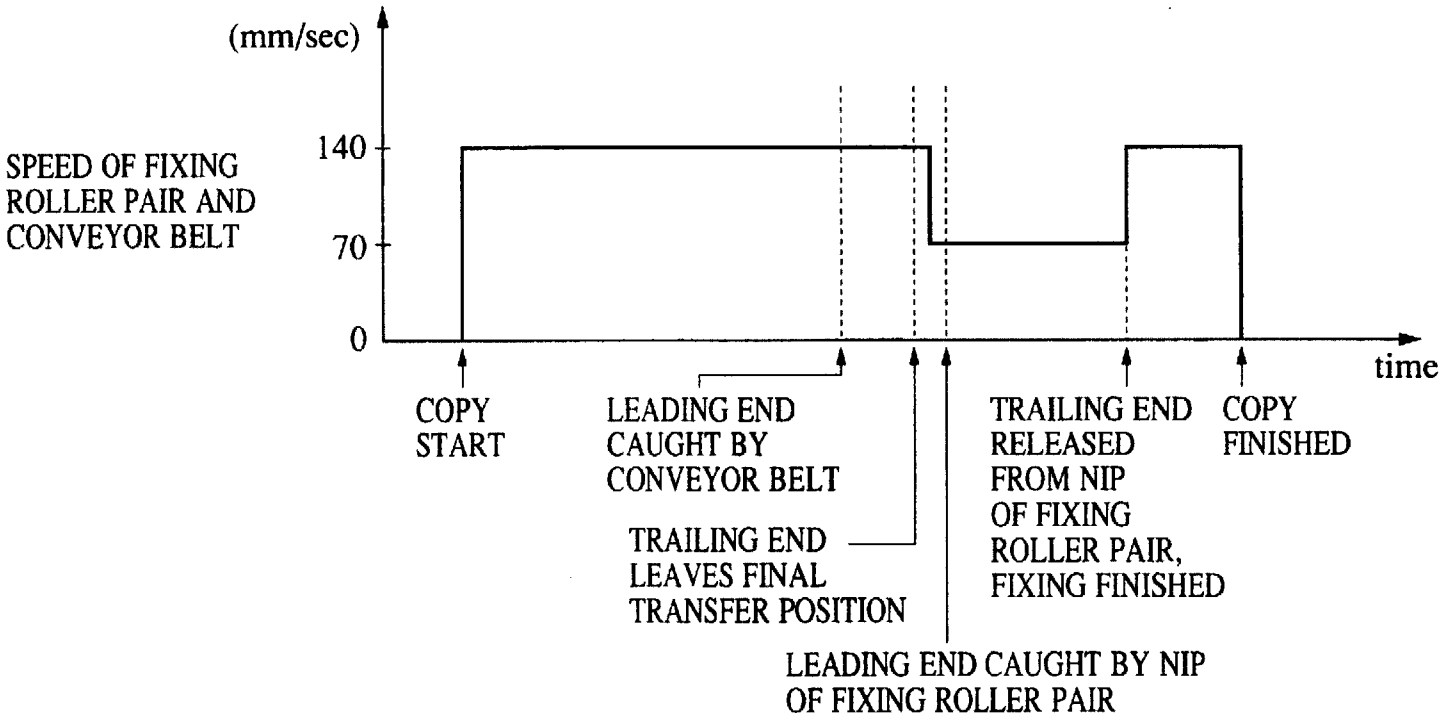
FIG. 3 is a timing chart which illustrates a first comparative embodiment.

In FIG. 3, the speeds of the fixing roller pair 51 and 52 and the conveyor belt 62 are reduced from 140 mm/sec to 70 mm/sec after the trailing end of the transparent laminated film passes through the final transfer position and before the leading end rushes into the fixing nip. In this case, when the transparent laminated film rushes into the fixing nip, the speeds of the fixing roller pair 51 and 52 and the conveyor belt 62 are 70 mm/sec. Thus, oil accumulates at the entrance of the fixing nip and the force of the transparent laminated film when rushing into the fixing nip becomes small as compared with the timing shown in FIG. 1, thereby causing slippage of the transparent laminated film at the time of rushing into the fixing nip. Therefore, as described in the first embodiment, by reducing the speeds of the fixing roller pair 51 and 52 and the conveyor belt 62 with the timing at least after inrush of the leading end of the transparent laminated film into the fixing nip, the slippage of the transparent laminated film is eliminated, and a good fixing of the image to the transparent laminated film can be performed.

A variable speed sequence of this embodiment is not limited to the transparent laminated film. It may be preferably applied also to a recording member P having a smooth surface, such as a coated paper having at least a resin layer on the surface thereof. More particularly, the transparent laminated film and coated paper are slippery because the surfaces thereof are resins, and the variable speed sequence of this embodiment may be effectively performed.

A second embodiment of the present invention will now be described. Since the basic construction of the apparatus is similar to that of the first embodiment, only the differences between the embodiments will be described.

In this embodiment, a variable speed sequence in which the recording member P is cardboard having a thickness (for example, 200 μm) thicker than the plain paper thickness will be described with reference to FIGS. 4 and 5.

Figure 4:
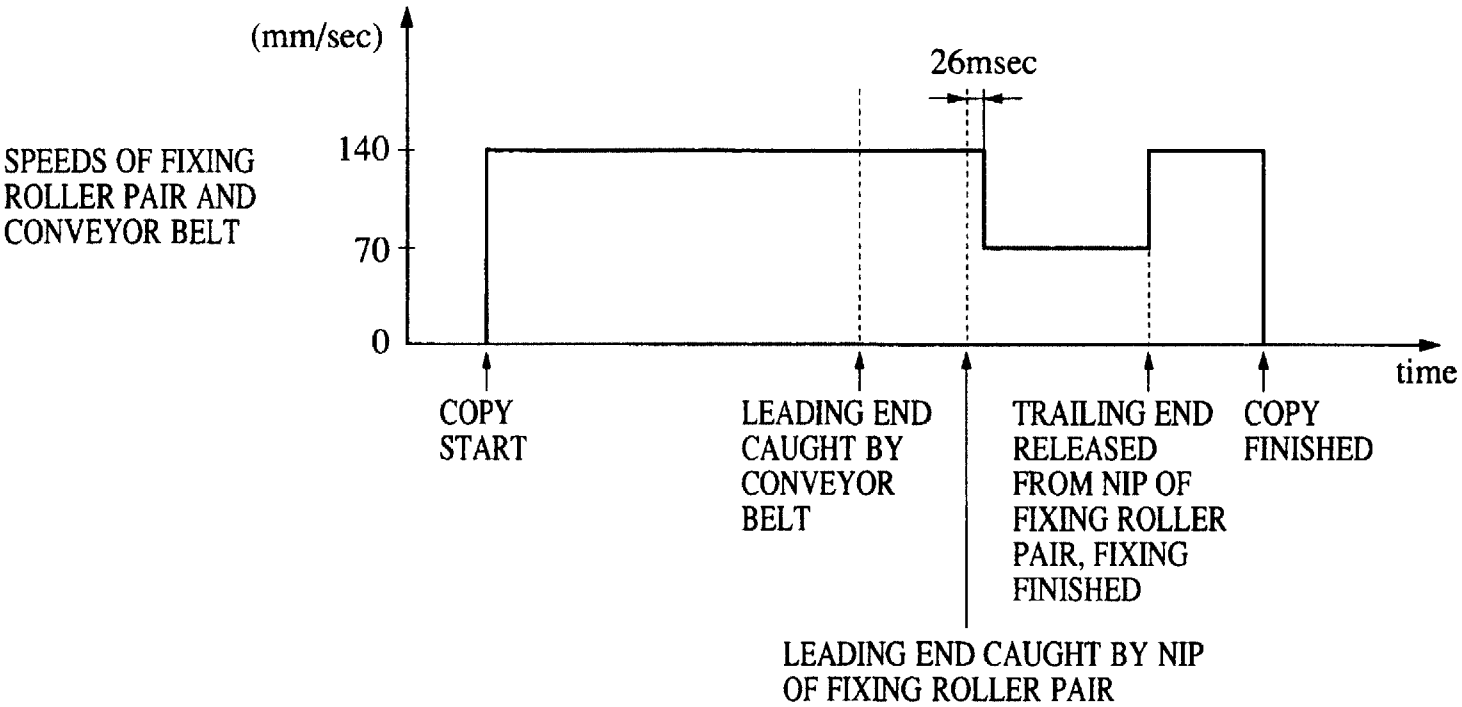
FIG. 4 is a timing chart which illustrates a second embodiment of the present invention.

Referring to FIG. 4, the horizontal axis represents the time after the start of a copying operation, and the vertical axis represents the rotative speeds of the fixing roller pair 51 and 52 and the conveyor belt 62. When a cardboard mode (an alternative second mode) is set, and a copy button is pressed to start a copying operation, the fixing roller pair 51 and 52, and the conveyor belt 62 start to rotate at a speed of 140 mm/sec for conveying the cardboard in accordance with the speed of the image forming section, e.g. transfer belt 31.

After the trailing end of the cardboard has passed through a final transfer position and a predetermined time of 26 msec expires since the leading end has moved into the entrance of the fixing nip, the speeds of the fixing roller pair 51 and 52 and the conveyor belt 62 are reduced from 140 mm/sec to 70 mm/sec, and increased to 140 mm/sec again after completion of fixing to discharge the cardboard.

Figure 5:
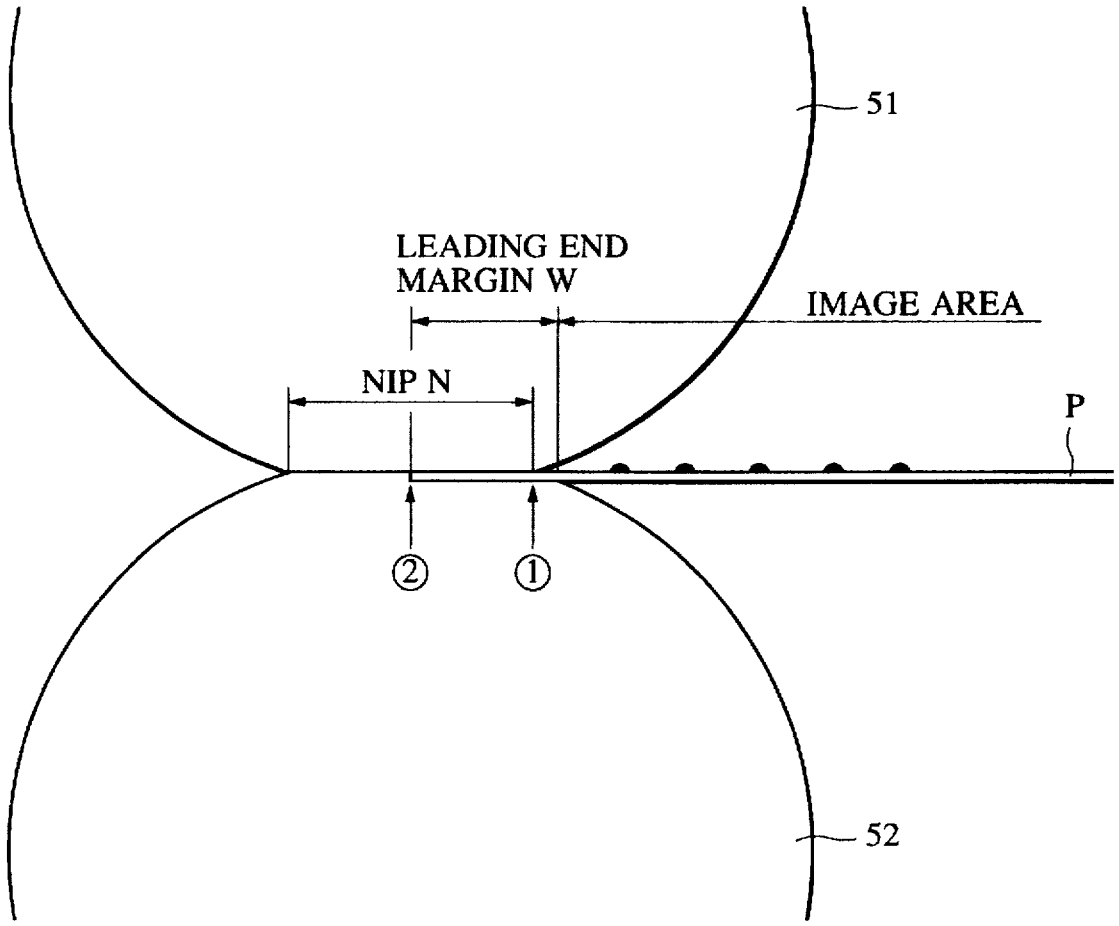
FIG. 5 is a view for explaining the second embodiment of the present invention.

FIG. 5 illustrates the state of the fixing nip when the rotative speed of the fixing roller pair 51 and 52 is switched from 140 mm/sec to 70 mm/sec.

As shown in FIG. 5, according to this embodiment, when the leading end of the cardboard gets to the position (2), where 26 msec has passed since the leading end reached the entrance (1) of the fixing nip, in other words, when the leading end of the cardboard is clamped by the fixing roller pair 51 and 52 and the leading end reaches the fixing nip, the rotative speed of the fixing roller pair 51 and 52 is switched from 140 mm/sec to 70 mm/sec. In this embodiment, since the width of the fixing nip N is 7.5 mm and the cardboard advances about 3.6 mm (=140 mm/sec×26 msec) from the entrance of the fixing nip, the rotative speed of the fixing roller pair 51 and 52 is switched when the leading end gets to a substantially center portion of the fixing nip.

In addition, according to this embodiment, the leading end of the cardboard includes 4 mm of a leading end margin W on which no image is formed. When the leading end of the cardboard is at the position of (2), the trailing end of the leading end margin W, e.g. the leading end of the image area, does not move into the fixing nip.

According to this embodiment, in the event that an image is fixed on the cardboard, the rotative speed of the fixing roller pair 51 and 52, which is the fixing speed, is reduced to 70 mm/sec to increase fixing properties. Thus, heat and pressure can be sufficiently applied throughout the recording member even if the recording member is cardboard, so that good image quality can be obtained.

Usually, due to the reduced speed of the fixing roller pair 51 and 52, the oil accumulated at the entrance of the fixing nip and the leading end of the cardboard slips on the fixing roller pair 51 and 52 before moving into the fixing nip, so that it sometimes becomes incapable of moving into the fixing nip. Even when the leading end of the cardboard can move into the fixing nip, the oil accumulated at the entrance of the fixing nip may produce stains on the cardboard.

According to this embodiment, at the moment when the cardboard moves into the fixing nip, the rotative speed of the fixing roller pair 51 and 52 is not reduced but is maintained at a normal speed (140 mm/sec), the image forming speed (e.g., the speed of transfer belt 31). Therefore, the accumulation of oil at the entrance of the fixing nip can be prevented, whereby the cardboard can be securely clamped.

In addition, production of stains due to the oil accumulated at the entrance of the fixing nip can be prevented.

Further, according to this embodiment, the speed of the conveyor belt 62 for conveying the cardboard to the fixing roller pair 51 and 52 remains at a high speed (140 mm/sec) when the cardboard moves into the entrance of the fixing nip. Therefore, the cardboard can be forcibly conveyed to the fixing nip, whereby slippage of the cardboard caused at the time of rushing into the fixing nip can be prevented more surely.

Still further, according to this embodiment, since the leading end of the cardboard is clamped and the fixing speed becomes slow before the image area moves into the fixing nip, fixing properties of the image will not be deteriorated.

In this embodiment, the speeds of the fixing roller pair 51 and 52 and the conveyor belt 62 are reduced after 26 msec since the leading end of the cardboard rushed into the fixing nip. However, the time of 26 msec is not limited thereto because it varies in accordance with the speed of the conveyor belt 62 of the apparatus. The speeds of the fixing roller pair and the conveyor belt 62 may be reduced at least after an inrush of the cardboard into the fixing nip.

A third embodiment of the present invention will now be described with reference to FIGS. 9(A) to 11(C). Since the basic construction of the apparatus is similar to that of the first embodiment, only the differences between the embodiments will be described.

Figure 9A:
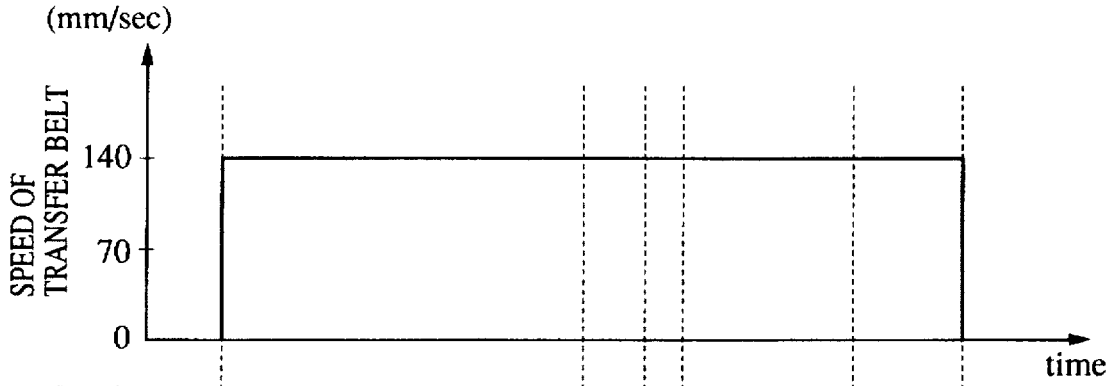
FIGS. 9(A)–(C) are timing charts which illustrate a third embodiment of the present invention.
Figure 9B:
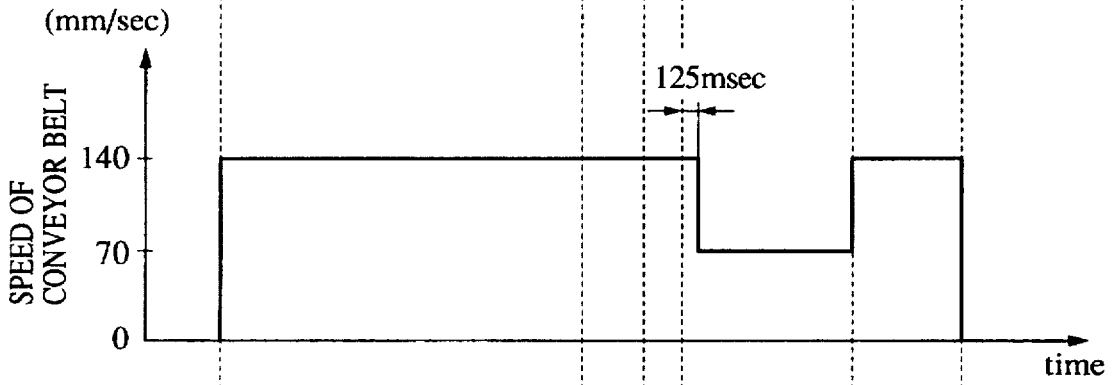
Figure 9C:
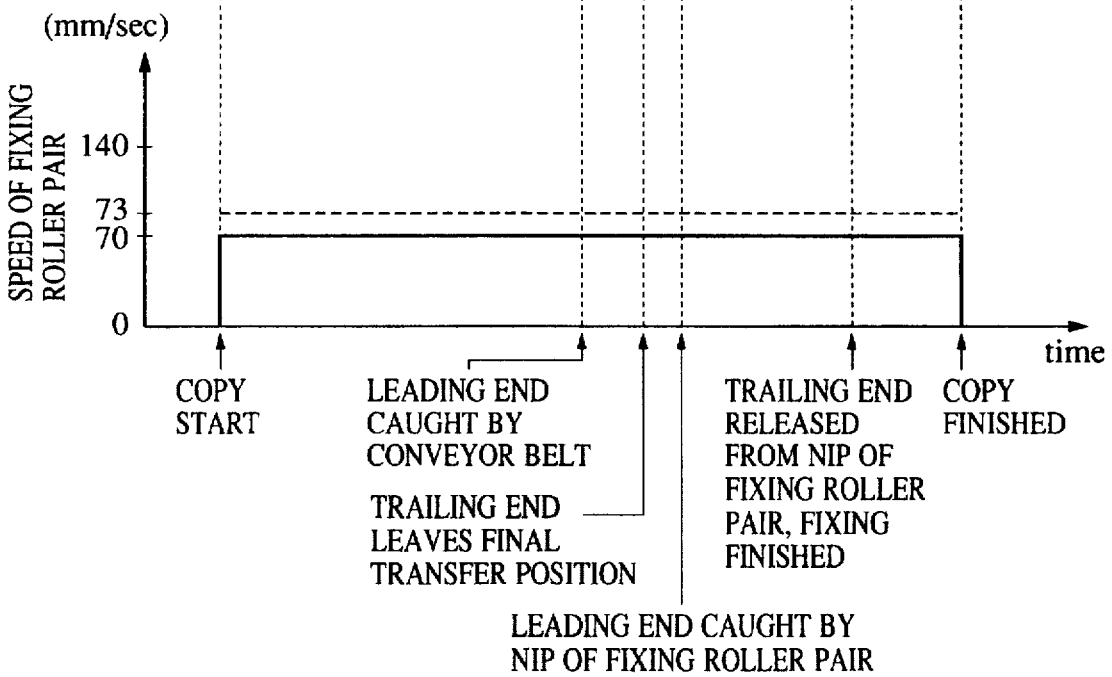

A fixing operation in which a transparent laminated film for OHP having at least a resin layer on the surface thereof is used as the recording member P will be described with reference to FIGS. 9(A)–(C). Referring to FIGS. 9(A)–(C), the horizontal axes represent the time after the start of a copying operation, and the vertical axes represent the rotative speed of the transfer belt 31 corresponding to the speed of the image forming section of the body of the apparatus, the rotative speed of the conveyor belt 62 and the rotative speed of the fixing roller pair 51 and 52, respectively.

When a transparent laminated film mode is set, and a copy button is pressed to start the copying operation, the conveyor belt 62 starts to rotate at a speed of 140 mm/sec, similar to that for conveying the plain paper (thickness: about 90 μm), in accordance with the speed (140 mm/sec) of the image forming section of the apparatus, e.g., the speed of transfer belt 31 and the fixing roller pair 51 and 52 start to rotate at a speed for fixing the transparent laminated film for OHP (70 mm/sec), which is lower than the speed for fixing the plain paper, to prevent abrasions of the rollers.

After the trailing end of the transparent laminated film has passed through a final transfer position and a predetermined time of 125 msec expires since the leading end has moved into the entrance of the fixing nip, the speed of the conveyor belt 62 is reduced from 140 mm/sec to 70 mm/sec, and increased to 140 mm/sec again after completion of fixing.

Figure 10:
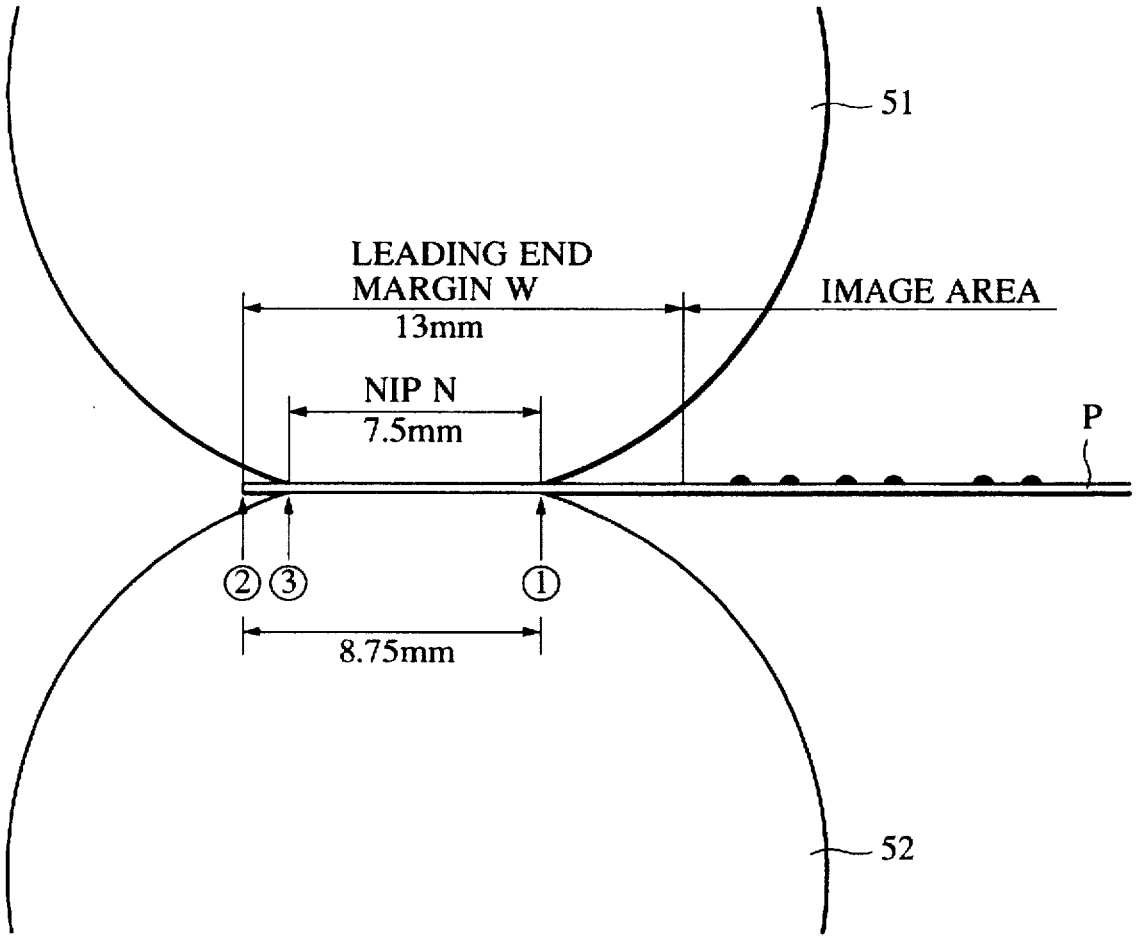
FIG. 10 is a view for explaining the third embodiment of the present invention.

FIG. 10 illustrates the state of the fixing nip when the rotative speed of the conveyor belt 62 is switched from 140 mm/sec to 70 mm/sec.

As shown in FIG. 10, according to this embodiment, when the leading end of the transparent laminated film gets to the position (2) where 125 msec has passed since it reached the entrance (1) of the fixing nip, in other words, when the leading end of the transparent laminated film is clamped by the fixing roller pair 51 and 52 and the leading end exits the fixing nip at position (3), the speed of the conveyor belt 62 is switched from 140 mm/sec to 70 mm/sec. In this embodiment, the width of the fixing nip N is 7.5 mm and the speed of the conveyor belt 62 is switched at the position (2) where the transparent laminated film advances 8.75 mm (=70 mm/sec×125 msec) from the entrance of the fixing nip. In addition, according to this embodiment, the leading end of the transparent laminated film includes 13 mm of a leading end margin W on which no image is formed. When the leading end of the transparent laminated film is at position (2), the trailing end of the leading end margin W, e.g., the leading end of the image area, does not move into the fixing nip.

According to this embodiment, the fixing roller pair 51 and 52 rotates at a low speed for fixing the unfixed toner image formed in the image forming section. Thus, abrasions of the roller pair 51 and 52 can be prevented, thereby improving their durability.

In addition, the speed of the conveyor belt 62 for conveying the transparent laminated film to the fixing roller pair 51 and 52 remains at a high speed (140 mm/sec) when the transparent laminated film moves into the entrance of the fixing nip. Therefore, the transparent laminated film can be forcibly conveyed to the fixing nip, whereby slippage of the transparent laminated film caused at the time of rushing into the fixing nip can be prevented.

Further, since the speed of the conveyor belt 62 at the time of fixing is the same as the rotative speed of the fixing roller pair 51 and 52 (70 mm/sec), jamming and image deterioration are prevented.

The speed of the conveyor belt 62 when rushing into the fixing nip may be faster than the rotative speed of the fixing roller pair 51 and 52, and need not be the same as the speed for conveying the plain paper.

The difference in speed between the conveyor belt 62 and the fixing roller pair 51 and 52 at the time of the inrush of the transparent laminated film into the fixing nip may preferably be relatively large because an inrush force of the transparent laminated film should be large.

Still further, according to this embodiment, the speed of the conveyor belt 62 is reduced after the leading end of the transparent laminated film is clamped in the fixing nip and before the image area moves into the fixing nip. Therefore, there is no bad influence on the image to deteriorate the image quality.

In this embodiment, the speed of the conveyor belt 62 is reduced after 125 msec since the leading end of the transparent laminated film rushes into the fixing nip. However, the time of 125 msec is not limited thereto because it varies in accordance with the speed of the conveyor belt 62 of the apparatus. The speeds of the fixing roller pair 51 and 52 and the conveyor belt 62 may be reduced at least after an inrush of the leading end of the transparent laminated film into the fixing nip.

A second comparative embodiment of this embodiment will be described with reference to FIGS. 11(A)–(C).

Figure 11A:
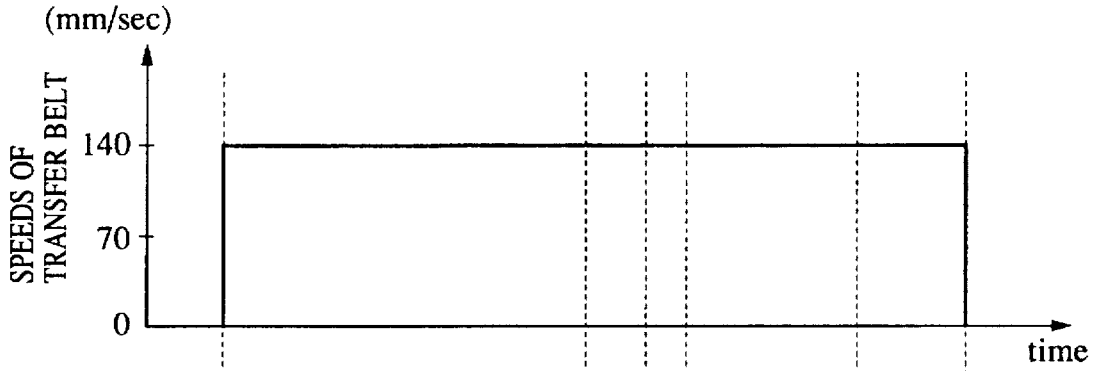
FIGS. 11(A)–(C) are timing charts which illustrate a second comparative embodiment.
Figure 11B:
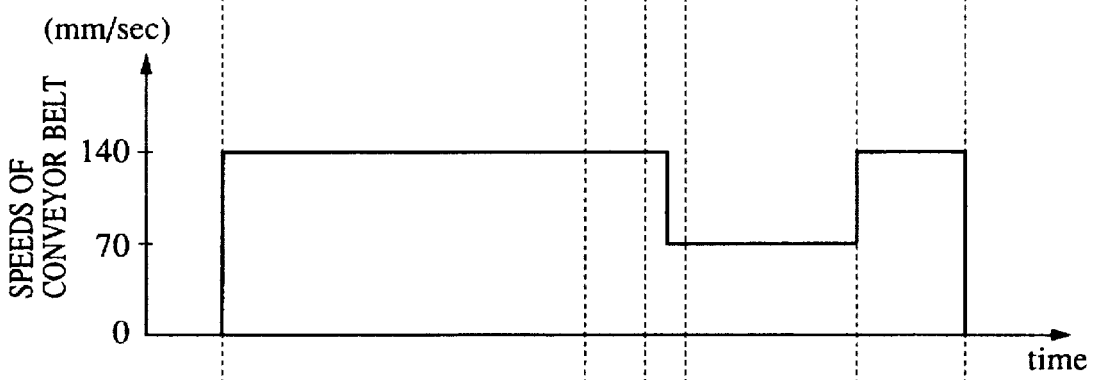
Figure 11C:
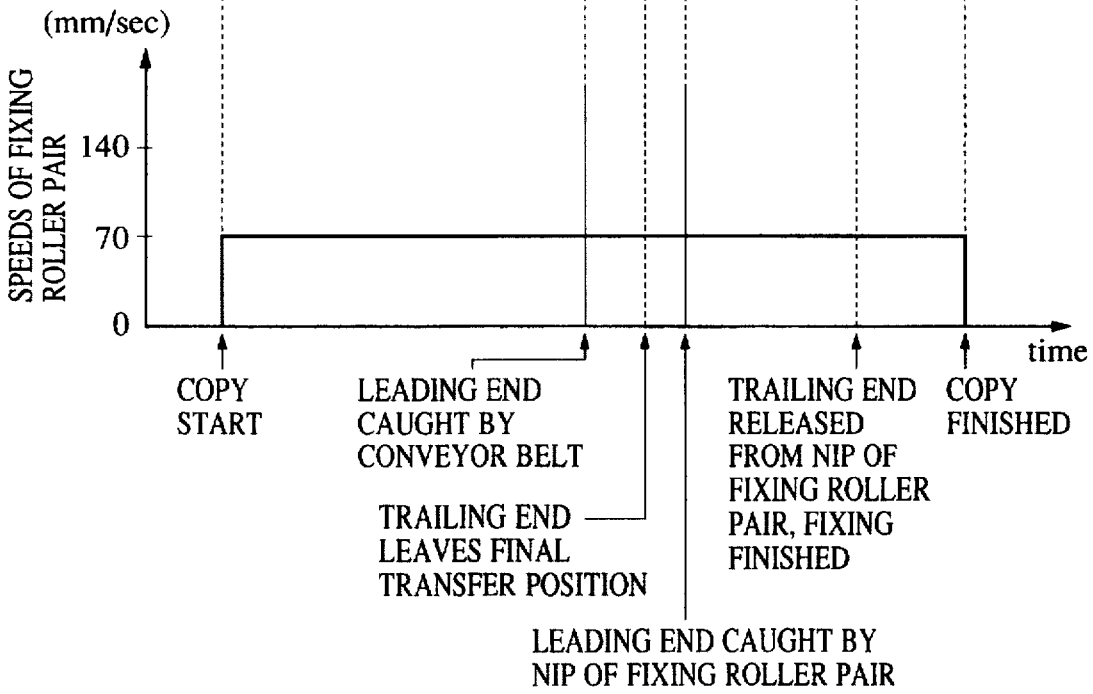

In FIGS. 11(A)–(C), the speeds of the fixing roller pair 51 and 52 and the conveyor belt 62 are reduced from 140 mm/sec to 70 mm/sec after the trailing end of the transparent laminated film passes through the final transfer position and before the leading end rushes into the fixing nip. In this case, when the transparent laminated film rushes into the fixing nip, the speeds of the fixing roller pair 51 and 52 and the conveyor belt 62 are 70 mm/sec. Thus, the force of the transparent laminated film when rushing into the fixing nip becomes smaller than the force when rushing into the fixing nip at the timing shown in FIGS. 9(A)–9(C), whereby slippage of the transparent laminated film may result when rushing into the fixing nip.

As described above, according to the third embodiment, by reducing the speed of the conveyor belt 62 to match the rotative speed of the fixing roller pair 51 and 52 after the leading end of the transparent laminated film has rushed into the fixing nip, the slippage of the transparent laminated film caused when rushing into the fixing nip can be prevented while improving durability of the fixing roller pair 51 and 52.

A fourth embodiment of the present invention will now be described. Since the basic construction of the apparatus is similar to that of the first embodiment, only the differences between the embodiments will be described.

This embodiment relates to an apparatus in which the rotative speed of the fixing roller pair 51 and 52 for fixing an unfixed image on the recording member P is faster than the image forming speed of the image forming section, e.g., the transfer belt 31.

When the image forming speed of the image forming section is slow, the image quality can be improved because when the rotative speed of the photoconductive drum is slowed down, the amount of light per unit of picture element increases, a contrast of a latent image can be easily obtained, developing properties are improved, and the picture element density can be increased. However, when the fixing speed is too slow in accordance with the image forming speed of the image forming section, an offset phenomenon in which the toner adheres to the fixing roller 51, and a poor separation of the recording member from the fixing roller 51 may result. Therefore, in this embodiment, an optimum fixing speed is faster than the image forming speed of the image forming section, e.g., the transfer belt 31.

A variable speed sequence of the rotative speeds of the transfer belt 31, conveyor belt 62 and the fixing roller pair 51 and 52 of this embodiment will be described with reference to FIGS. 12(A)–(C).

Figure 12A:
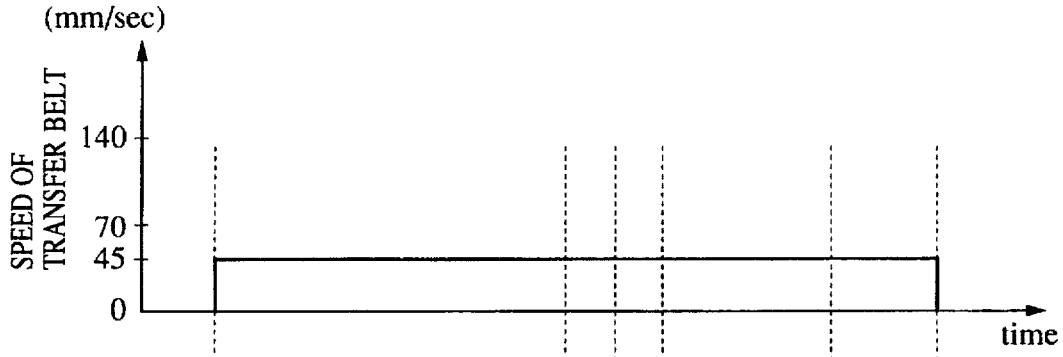
FIGS. 12(A)–(C) are timing charts which illustrate a fourth embodiment of the present invention.
Figure 12B:
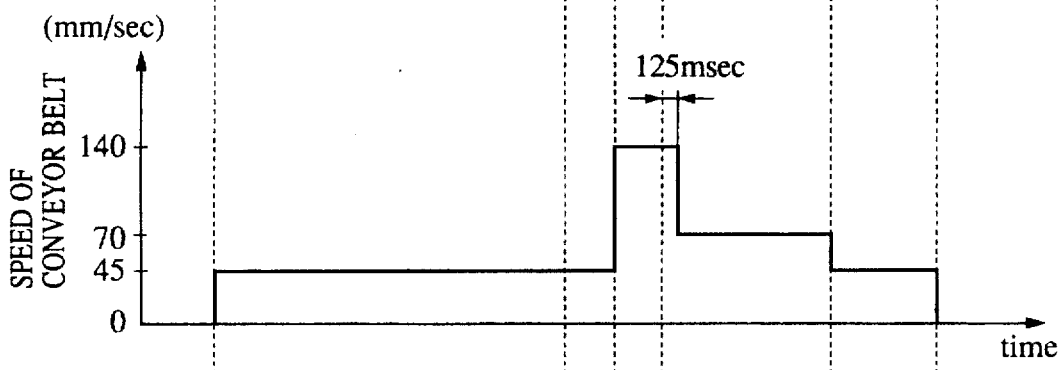
Figure 12C:
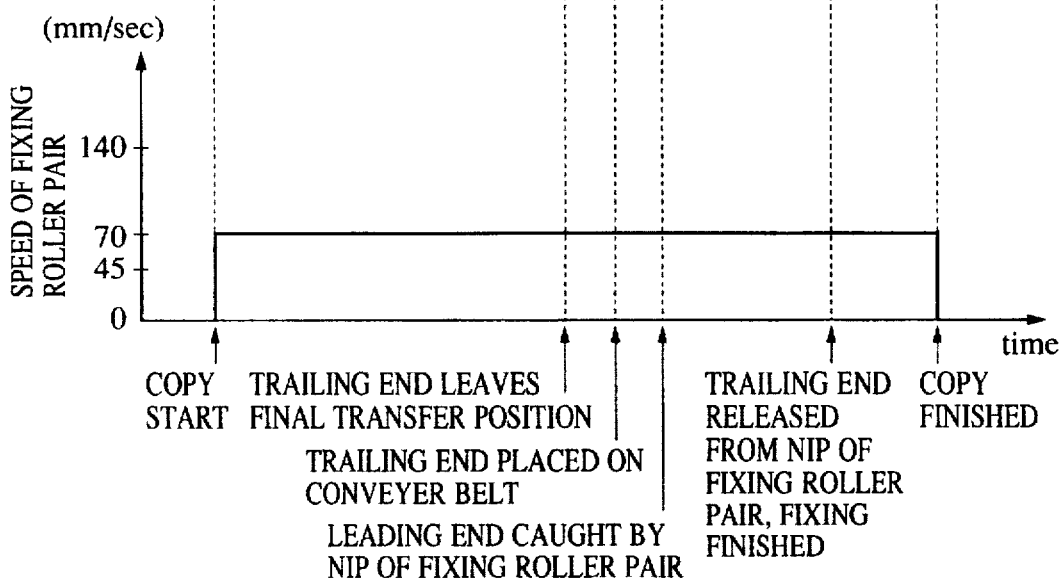

Referring to FIGS. 12(A)–(C), the horizontal axes represent the time after the start of a copying operation, and the vertical axes represent the rotative speeds of the transfer belt 31, the conveyor belt 62 and the fixing roller pair 51 and 52, respectively. In FIGS. 12(A)–(C), when the copy button is pressed to start copying, the conveyor belt 62 starts to rotate at a speed of 45 mm/sec, which is the speed in a mode of high image quality, in accordance with the speed of the image forming of the image forming section of the apparatus, e.g., the rotative speed of the transfer belt 31, and the fixing roller pair 51 and 52 start to rotate at a speed for fixing the transparent laminated film for OHP (70 mm/sec) to prevent abrasions of the fixing roller pair 51 and 52.

In this state, the transparent laminated film is fed to the image forming section, and the image is formed at an image forming speed of 45 mm/sec. That is, the transfer belt 31 rotates at a speed of 45 mm/sec. At the point of time when the trailing end of the transparent laminated film passes through the final transfer position to get on the conveyor belt 62 after completion of the image forming, the speed of the conveyor belt 62 is increased to 140 mm/sec.

After a predetermined time of 125 msec expires after the leading end of the transparent laminated film has moved into the fixing nip, the speed of the conveyor belt 62 is reduced from 140 mm/sec to 70 mm/sec, and increased to 140 mm/sec again after completion of fixing. The state of the fixing nip when the speed of the conveyor belt 62 is switched from the 140 mm/sec to 70 mm/sec is the same as that in the third embodiment.

As shown in FIG. 10, according to this embodiment, when the leading end of the transparent laminated film gets to the position (2) where 125 msec has passed since it reached the entrance (1) of the fixing nip, in other words, when the leading end of the transparent laminated film is clamped by the fixing roller pair 51 and 52 and the leading end gets out of the fixing nip, the speed of the conveyor belt 62 is switched from 140 mm/sec to 70 mm/sec. In this embodiment, the width of the fixing nip N is 7.5 mm and the speed of the conveyor belt 62 is switched at the position (position (2)) where the transparent laminated film advances 8.75 mm (=70 mm/sec×125 msec) from the entrance of the fixing nip.

In addition, according to this embodiment, the leading end of the transparent laminated film includes 13 mm of a leading end margin W on which no image is formed. When the leading end of the transparent laminated film is at position (2), the trailing end of the leading end margin W, e.g., the leading end of the image area does not move into the fixing nip.

According to this embodiment, the image forming speed is slow (45 mm/sec), whereby an image of high quality can be formed.

In addition, since the speed of the conveyor belt 62 is increased after the trailing end of the transparent laminated film passes through the final transfer position, there is no deterioration of the image due to a transfer offset.

Further, the speed of the conveyor belt 62 for conveying the transparent laminated film to the fixing roller pair 51 and 52 remains at a high speed (140 mm/sec) when the recording member moves into the entrance of the fixing nip. Therefore, the transparent laminated film can be forcibly conveyed to the fixing nip, whereby slippage of the transparent laminated film caused when rushing into the fixing nip can be prevented.

Still further, since the speed of the conveyor belt 62 at the time of fixing is the same as the rotative speed of the fixing roller pair 51 and 52 (70 mm/sec), there is neither degradation of the image nor bad conveyance of the transparent laminated film.

In this embodiment, a greater difference in speed between the conveyor belt 62 and the fixing roller pair 51 and 52 when the transparent laminated film rushes into the fixing nip may also be preferable, as in the case of the third embodiment.

In this embodiment, the speed of the conveyor belt 62 is reduced after 125 msec since the leading end of the transparent laminated film rushes into the fixing nip. However, the time of 125 msec is not limited thereto because it varies in accordance with the speed of the conveyor belt 62 of the apparatus. The speed of the conveyor belt 62 may be reduced at least after an inrush of the leading end of the transparent laminated film into the fixing nip.

A third comparative embodiment of this embodiment will now be described with reference to FIGS. 13(A)–(C).

Figure 13A:
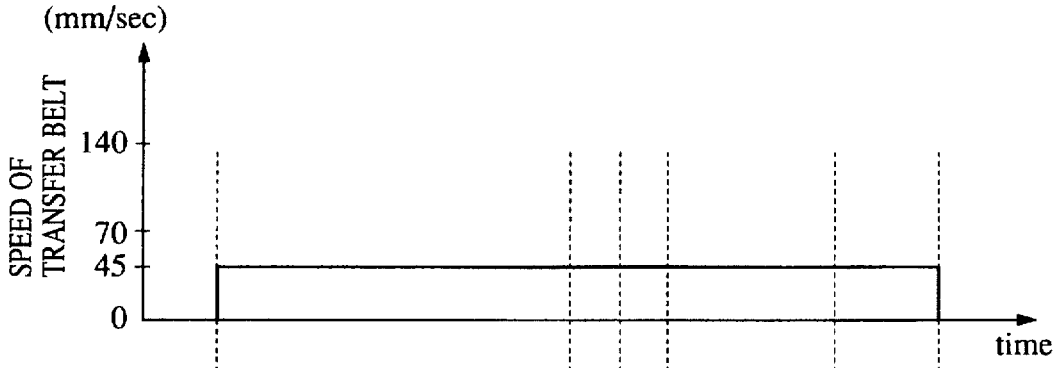
FIGS. 13(A)–(C) are timing charts which illustrate a third comparative embodiment.
Figure 13B:
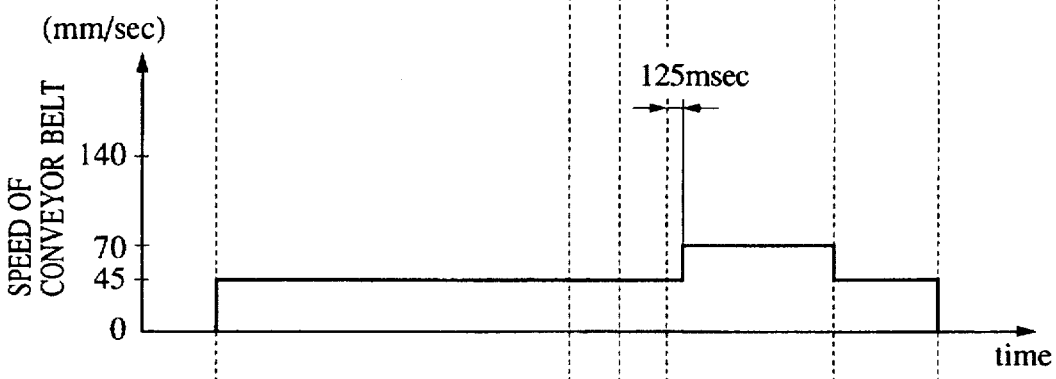
Figure 13C:
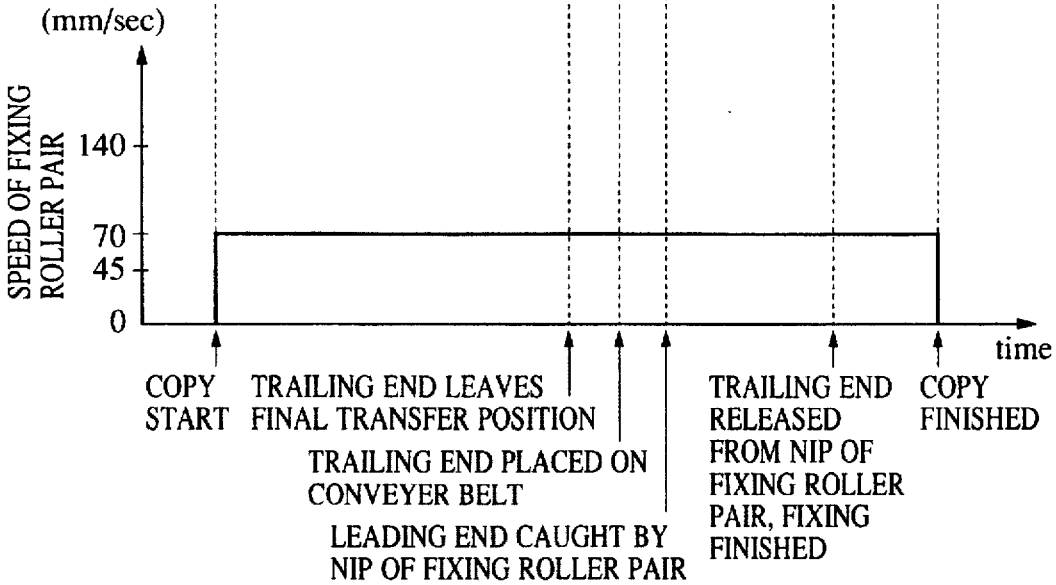

In FIGS. 13(A)–(C), when the rotative speeds of the transfer belt 31, and the conveyor belt 62 after the copying operation begins are 45 mm/sec, and the rotative speeds of the fixing roller pair 51 and 52 is 70 mm/sec, the transparent laminated film is conveyed at the speed of the 45 mm/sec at the time of the passage of the trailing end thereof through the final transfer position, and the inrush of the leading end thereof into the fixing nip.

In this case, when the transparent laminated film rushes into the fixing nip, the speeds of the fixing roller pair 51 and 52 and the conveyor belt 62 are 45 mm/sec. Thus, the force of the transparent laminated film when rushing into the fixing nip is small, whereby slippage of the transparent laminated film may be caused when rushing into the fixing nip.

As described above, by increasing the speed of the conveyor belt 62 to be faster than that of the fixing roller pair 51 and 52, the slippage of the leading end of the transparent laminated film can be eliminated, and fixing can be performed by decreasing the speed of the conveyor belt 62 after the leading end of the transparent laminated film rushes into the fixing nip.

According to this embodiment, the speed of the conveyor belt 62 is increased to be faster than an image forming speed of the image forming section after the trailing end of the recording member P passes through the final transfer position. Therefore, the time required for the unfixed image formed on the recording member P to be fixed can be shortened, while preventing the image shearing on the recording member P.

By increasing the speed of the conveyor belt 62 as described above, it is also possible to reduce the entire delay of the image forming time, which is caused by the prolonged fixing time.

Although the fixing roller pair 51 and 52 is used as the fixing means in the above first to fourth embodiments, the fixing means are not limited thereto, and any means will be employed so long as they can form the fixing nip.

In addition, in the above first to fourth embodiments, although the length of the conveyor belt 62 is longer than a maximum length of the transfer paper P, the distance between the final transfer position and the fixing nip may be longer than a maximum length of the transfer paper P even if the length of the conveyor belt 62 is shorter than the maximum length of the transfer paper P.

Further, in the above first to fourth embodiments, the rotative speed of the fixing roller pair 51 and 52 at the time of inrush of the transparent laminated film or cardboard into the fixing nip may be slightly faster than that of the conveyor belt 62 because a pulling effect of the fixing nip is exhibited, so that the slippage of the transparent laminated film or cardboard caused when rushing into the fixing nip can be prevented more surely.

More specifically, in the case of the first and the third embodiments, the rotative speed of the fixing roller pair 51 and 52 may be preferably set to about 71 to 73 mm/sec with respect to the rotative speed of 70 mm/sec of the conveyor belt 62, as shown in broken lines of FIGS. 1 and 9(C).

Speed reduction sequences in the above first to fourth embodiments are not limited to be applied to a recording member P having a resin layer on the surface thereof, such as a transparent laminated film and coated paper, and a thick recording member P. Even if the recording member P is plain paper, when the speed of the fixing roller pair 51 and 52 is reduced to improve fixing properties and give a polish to the image, the speed reduction sequences similar to those of the above first and second embodiments may be preferably performed to prevent slippage.

Still further, according to the above first to fourth embodiments, the transparent laminated film mode (or the cardboard mode) is set and the copy button is pressed to start the copying operation. However, the copying operation may be automatically started by manually feeding the transparent laminated film (or cardboard) into the apparatus so as to be detected the feeding thereof. At this time, if a recording member detecting means is provided in the apparatus for detecting a type and a thickness of the recording member P, the speed reduction sequences of the above first to fourth embodiments which match with the recording member P to be fed by only feeding the recording member P will be performed without a user setting the type and the thickness thereof.

Although the preferred embodiments of the present invention have been described above, the present invention is not limited thereto, and any changes and modifications can be made without departing from the spirit and scope of the present invention.

What is claimed is:

1. An image forming apparatus, comprising:

unfixed image forming means for forming an unfixed image on a recording member;

fixing means having a nip, said fixing means for holding and conveying the recording member carrying the unfixed image through said nip and fixing the unfixed image onto the recording member; and conveyor means for conveying the recording member to said fixing means, wherein said conveyor means can convey the recording member at one of a first speed and a second speed slower than the first speed, and wherein said conveyor means conveys the recording member at the first speed before a leading end of the recording member enters said nip, and at the second speed after the leading end of the recording member enters said nip.

2. An image forming apparatus according to claim 1, wherein said unfixed image forming means is positioned upstream of said conveyor means relative to a direction of conveyance of the recording member and delivers the recording member to said conveyor means.

3. An image forming apparatus according to claim 1, wherein a speed of conveying the recording member by said fixing means is the same when the speed of said conveyor means is the first speed and when the speed of said conveyor means is the second speed.

4. An image forming apparatus according to claim 1, wherein said fixing means conveys the recording member at the second speed.

5. An image forming apparatus according to claim 4, wherein a speed of conveying the recording member by said fixing means is the same when the speed of said conveyor means is the first speed and when the speed of said conveyor means is the second speed.

6. An image forming apparatus according to claim 1, wherein said fixing means conveys the recording member at a third speed which is faster than the second speed and slower than the first speed.

7. An image forming apparatus according to claim 6, wherein a speed of conveying the recording member by said fixing means is the same when the speed of said conveyor means is the first speed and when the speed of said conveyor means is the second speed.

8. An image forming apparatus according to claim 1, wherein said nip of said fixing means is formed by a rotation member and a press-contact member pressed into contact with said rotation member.

9. An image forming apparatus according to claim 8, wherein a surface of said rotation member has a release agent.

10. An image forming apparatus according to claim 8, wherein a surface of said press-contact member pressed into contact with said rotation member has a release agent.

11. An image forming apparatus according to claim 10, wherein said press-contact member is rotatably mounted.

12. An image forming apparatus according to claim 1, wherein said fixing means fixes the unfixed image on the recording member at a different time than the unfixed image is formed on the recording member by said unfixed image forming means.

13. An image forming apparatus according to claim 1, wherein a distance the recording member is conveyed by said conveyor means is greater than a maximum length of the recording member in a direction on conveyance.

14. An image forming apparatus according to claim 1, wherein said fixing means and said conveyor means are driven separately during conveyance of the recording member.

15. An image forming apparatus according to claim 1, wherein said unfixed image forming means comprises a plurality of transfer means for transferring images onto the recording member by sequentially superimposing the images.

16. An image forming apparatus according to claim 1, wherein said conveyor means conveys the recording member at the first speed before the leading end of the recording member is held at said nip, and at the second speed after the leading end is held at said nip, when the recording member has a resin layer on the surface thereof.

17. An image forming apparatus according to claim 1, wherein said conveyor means conveys the recording member at the first speed before the leading end of the recording member is held at said nip, and at the second speed after the leading end is held at said nip, when the recording member is thicker than a predetermined thickness.

18. An image forming apparatus, comprising:

unfixed image forming means for forming an unfixed image on a recording member conveyed at a first speed;

fixing means for fixing the unfixed image on the recording member; and conveyor means for conveying the recording member to said fixing means, wherein said conveyor means selectively conveys the recording member at one of the first speed and a second speed which is faster than the first speed.

19. An image forming apparatus according to claim 18, wherein said conveyor means conveys the recording member at the first speed and at the second speed.

20. An image forming apparatus according to claim 18, wherein said conveyor means conveys the recording member at the first speed while the unfixed image is being formed by said unfixed image forming means, and conveys the recording member at the second speed after the unfixed image is formed.

21. An image forming apparatus according to claim 18, wherein said fixing means conveys the recording member at a third speed which is slower than the second speed.

22. An image forming apparatus according to claim 18, wherein said fixing means fixes the unfixed image on the recording member at a different time than the unfixed image is being formed on the recording member by said unfixed image forming means.

23. An image forming apparatus according to claim 18, wherein said unfixed image forming means comprises a plurality of transfer means for transferring images onto the recording member by sequentially superimposing the images.

24. An image forming apparatus according to claim 23, wherein said fixing means comprises a nip at which the recording member is held and conveyed, and wherein a distance between said nip and a final transfer position of said unfixed image forming means is greater than a maximum length of the recording member in a direction of conveyance.

25. An image forming apparatus according to claim 18, wherein said unfixed image forming means is positioned upstream of said conveyor means relative to a direction of conveyance of the recording member and delivers the recording member to said conveyor means.

26. A fixing device, comprising:

a rotation member having a release agent on a surface thereof; and a press-contact member pressed into contact with said rotation member and forming a nip therebetween, wherein said rotation member can rotate at one of a first speed and a second speed slower than the first speed, and wherein said rotation member rotates at the first speed before a leading end of a recording member is held by said nip, and at the second speed after the leading end of the recording member is held by said nip.

27. A fixing device according to claim 26, wherein said rotation member comprises a heating roller.

28. A fixing device according to claim 26, wherein said press-contact member is rotatably mounted.

29. A fixing device according to claim 26, wherein said release agent comprises an oil.

30. A fixing device according to claim 26, further comprising application means for applying said release agent to said rotation member.

31. An image forming apparatus according to claim 18, wherein said conveyor means conveys a recording material while said fixing means is fixing unfixed image on said recording material.

32. An image forming apparatus according to claim 18, wherein said unfixed image forming means comprises a transfer means for transferring image onto the recording member, and said conveyor means conveys a recording material while said transferring means is transferring image onto said recording member.

* * * * *

UNITED STATES PATENT AND TRADEMARK OFFICE

CERTIFICATE OF CORRECTION

PATENT NO. : 5,729,818
DATED : March 17, 1998
INVENTOR(S) : Jiro ISHIZUKA, et al.

It is certified that error appears in the above-identified patent and that said Letters Patent is hereby corrected as shown below:

Title page, item [54] and col. 1, line 2, delete "CONVEYER" and insert therefor --CONVEYOR--.

Column 2, line 21, after "aspect", insert --of--.

Column 7, line 62, delete "=" and insert therefor --≈--.

Signed and Sealed this

Third Day of November, 1998

*Attest:*

*Attesting Officer*

BRUCE LEHMAN

*Commissioner of Patents and Trademarks*